United States Patent [19]

Darner

[11] 4,297,545

[45] Oct. 27, 1981

[54] SWITCHING MEANS FOR A TIMING MECHANISM

[75] Inventor: Ronald G. Darner, Bargersville, Ind.

[73] Assignee: Emhart Industries, Inc., Indianapolis, Ind.

[21] Appl. No.: 112,604

[22] Filed: Jan. 16, 1980

[51] Int. Cl.[3] ..... H01H 7/00

[52] U.S. Cl. ..... 200/38 R; 200/153 V; 200/283

[58] Field of Search ..... 200/38 R, 38 A, 38 F, 200/38 FA, 38 FB, 38 B, 38 BA, 38 C, 38 CA, 38 D, 38 DA, 38 DB, 38 DC, 38 E, 39 R, 39 A, 283, 153 V

[56] References Cited

U.S. PATENT DOCUMENTS 2,736,173 2/1956 Duncan ..... 200/38 CA

*Primary Examiner*—James R. Scott
*Assistant Examiner*—Morris Ginsburg
*Attorney, Agent, or Firm*—Robert F. Meyer; David W. Gomes

[57] ABSTRACT

A pair of movable electrical contact blades are linked together through a lost motion linkage. An actuator means engages one of the blades to initially move it by itself. Subsequent movement of the actuator means moves both blades to selectively open and close electrical contacts carried by the blades and to open and close an electrical contact carried by a fixed contact blade.

5 Claims, 4 Drawing Figures

SWITCHING MEANS FOR A TIMING MECHANISM

BACKGROUND OF THE INVENTION

Generally speaking, the present invention pertains to an improvement in electrical switches wherein cooperating electrical contacts, carried by a fixed blade contact blade and a pair of movable contact blades, are sequentially opened and closed through movement of the pair of movable contact blades; the improvement being directed to a means providing individual sequential movement of the pair of movable contact blades with respect to the fixed blade, including a drive means, an actuator means actuated by the drive means and engaging a blade of the pair of movable contact blades, and a lost motion linkage carried by the pair of movable contact blades and linking them together. An initial movement of the actuator means causes movement of the first movable blade with continuous movement causing movement of both the movable blades.

The present invention pertains to an electrical switching means and more particularly to an electrical switching means for a timing mechanism which provides a short pulsing cycle at the start of a timing program.

Timing mechanisms have for some time been used to control the functions of various appliances such as washers, dryers and microwave ovens. Depending upon the application, such timing mechanisms need to provide various programs. For example, in the case of a timing mechanism for a microwave oven there is a need to provide a short pulsing cycle operable at the start of the overall program. Such a system usually requires a switching arrangement which needs to be highly accurate to provide an accurate short pulse.

OBJECTS OR FEATURES OF THE INVENTION

Accordingly, it is a feature of the present invention to provide a switching arrangement useful in a timing mechanism for providing short pulses. Another feature of the invention is to provide such a switching arrangement wherein the switching arrangement is provided by two parallel movable blades and a fixed parallel blade, each having at least one electrical contact in operational alignment with each other and wherein an actuator means causes movement of the two movable blades. Another feature of the invention is the provision of such a switching arrangement wherein the two movable blades are linked together by a lost motion linkage so that one blade can be initially moved independent of the other and then both moved together. These and other features of the invention will be apparent from the following description taken in conjunction with the accompanying drawings.

DETAILED DESCRIPTION OF THE INVENTION

Figure 1:
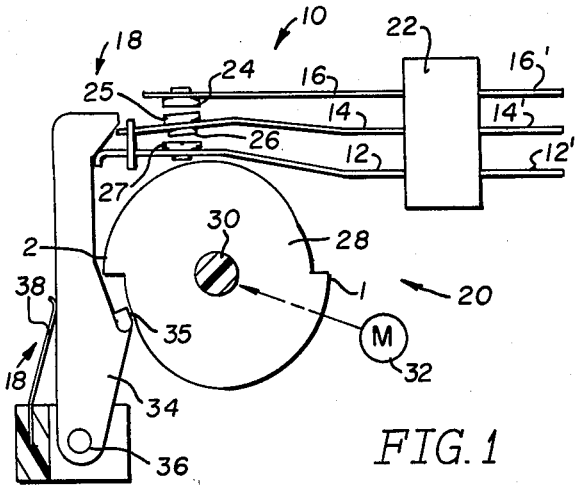
FIGS. 1–3 are three similar views of the switching arrangement showing the arrangement at three different stages of operation.

Referring to the drawings, there is shown a switching arrangement 10 which in general includes a pair of movable contact blades 12 and 14, a fixed blade 16, an actuator means 18, and a drive means 20 which actuates the actuator means. The blades are carried in a terminal block 22 that is fabricated from a suitable dielectric material. As shown, blade 12 is longer than blade 14 for reasons to be hereinafter described. The blades extend through the block to provide electrical terminals 12', 14' and 16' respectively, the blades and the terminals being fabricated from a good electrically conductive material such as copper. Disposed at the distal ends of the blades are cooperating electrical contacts 24, 25, 26 and 27 each also being fabricated from a good electrically conductive material such as copper or a copper-tungsten alloy.

Drive means 20 includes a cam 28 carried on shaft 30 that is driven by suitable power drive means such as a synchronous motor 32. As shown cam 28 has two steps or lobes 1 and 2 which provide respective operating positions of actuator means 18 to selectively open and close the electrical contacts 24–27.

Actuator means 18, in the illustrative embodiment, includes a lever 34 pivotally mounted on a post 36 and which is spring biased toward cam 28 through a leaf spring 38 and which engages the cam through follower 35. As shown, the distal end 40 of the lever inclues a ramp surface 42 which engages the distal end 44 of movable blade 12. The distal end 44 of the movable blade includes a bent over portion 46 to provide a smooth engagement with ramp surface 42.

Figure 4:
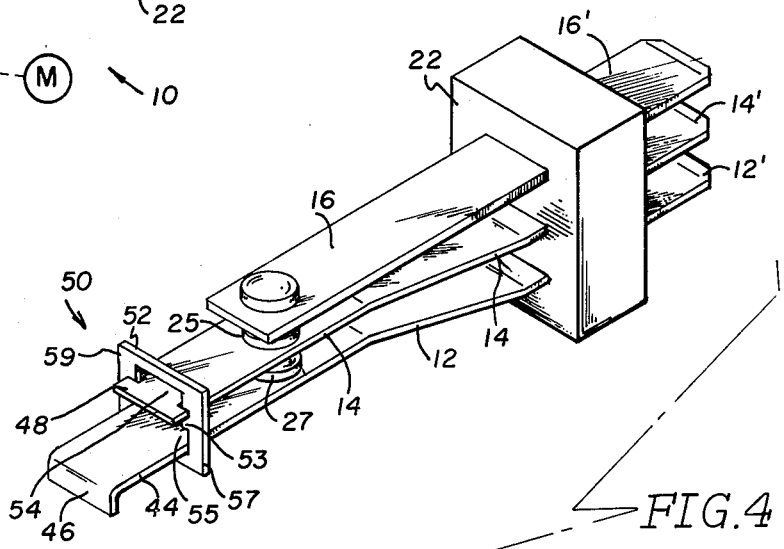
FIG. 4 is an isometric view showing the lost motion linkage of the switching arrangement.

The movable blades are linked together, but are left free to be independently movable through lost motion linkage means 50. Referring to FIG. 4, lost motion linkage means 50 includes a loop surrounding and loosely carried at the distal ends 44 and 48 of movable blades 12 and 14 respectively. The loop is divided into two spaces 54 and 55 by a pair of oppositely disposed tabs 53 provided in opposite walls 57 and 59 of the loop. As shown, blade 14 is free to slide and move up and down in space 54 while blade 12 is free to slide and move up and down in space 55.

Figure 2:
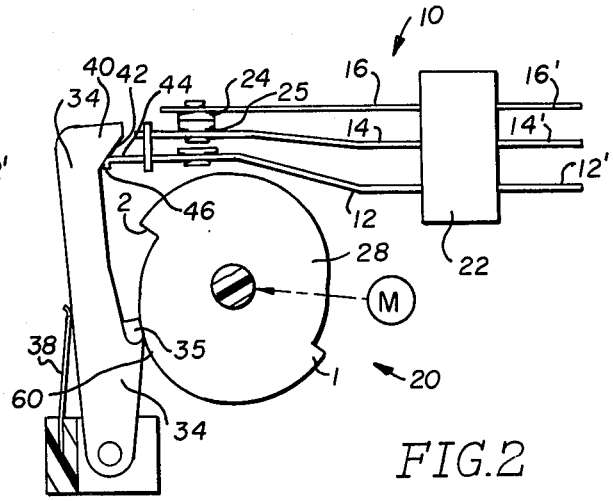
Figure 3:
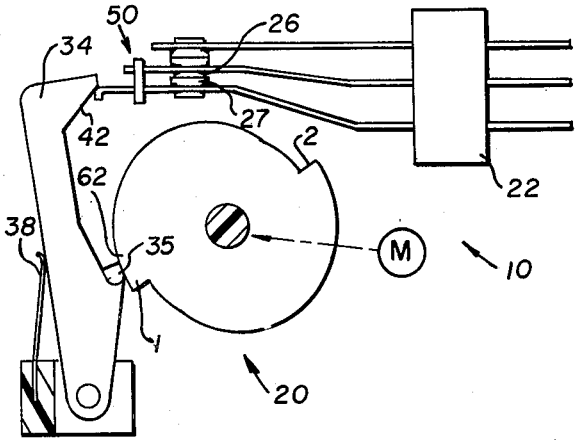

Referring to FIGS. 1–2, the operation of the device may now be described. In FIG. 1, follower 35 has just dropped off step 2 to "bottom out" and open all of the contacts. In FIG. 2, follower 35 has moved part way up the rise 60 of cam 28 to cause lever 34 to be biased away from the cam to permit the distal end 44 of blade 12 to slide up ramp surface 42 of the lever 34 to allow movable blade 14 to move and close contacts 24 and 25. In FIG. 3, follower 35 has reached the maximum rise 62 of the cam to further move lever 34 and allow blade 12 to further move and close contacts 26 and 27. Step 1 is now in position to permit the operation to be repeated.

What is claimed is:

1. In an electrical switching means wherein cooperating electrical contacts, carried by a fixed contact blade and a pair of movable contact blades, are sequentially opened and closed through movement of said pair of movable contact blades; a means providing individual sequential movement of said pair of movable contact blades with respect to said fixed blade comprising:

(a) a drive means, (b) cam means actuated by said drive means and a lever engaging said cam means and a first blade of said pair of movable contact blades, (c) a lost motion linkage means carried by said pair of movable contact blades and linking them together, whereby initial movement of said lever by said cam means causes movement of said first blade and continued movement thereof due to said lost motion linkage means causes movement of both of said pair of contact blades so as to selectively engage or disengage the electrical contacts carried by the movable blades and the fixed blade from each other.

2. In an electrical switching means according to claim 1 wherein said first blade is of a longer length than the other of said pair of movable contact blades to insure that said lever engages only said first blade.

3. In an electrical switching means according to claim 1 wherein said lever is pivotally mounted, and a distal end of same engages said blade.

4. In an electrical switching means according to claim 3 wherein said distal end includes a ramp engaging said blade and is of sufficient length to cause said blade to move a distance sufficient to move both said pair of contact blades.

5. In an electrical switching means according to claim 1 wherein said lost motion linkage means includes a loop substantially surrounding said pair of contact blades, said loop being of sufficient size to permit said movable blades to move independently of the other.

* * * * *